United States Patent [19]

Robbins

[11] Patent Number: 4,811,660

[45] Date of Patent: Mar. 14, 1989

[54] MECHANICAL LOCK-IN DEVICE FOR A FRONT LOADER COMPACTION ASSEMBLY

[75] Inventor: James K. Robbins, Fayette, Ala.

[73] Assignee: Marathon Corporation, Birmingham, Ala.

[21] Appl. No.: 140,785

[22] Filed: Jan. 5, 1988

[51] Int. Cl.[4] ..... B30B 15/06

[52] U.S. Cl. ..... 100/229 A; 414/408; 414/409; 414/406

[58] Field of Search ..... 100/229 A; 414/406, 414/408, 409, 411, 421; 141/281

[56] References Cited

U.S. PATENT DOCUMENTS

| | | | |
|---|---|---|---|
| 3,662,910 | 5/1972 | Herpich et al. | 414/406 |
| 3,687,317 | 8/1972 | Gagel | 414/411 |
| 3,874,534 | 4/1975 | Brisson | 414/406 |
| 4,088,071 | 5/1978 | Cruse et al. | 414/411 X |
| 4,363,588 | 12/1982 | Stickney | 414/408 |
| 4,603,626 | 8/1986 | Nall et al. | 100/229 A X |
| 4,715,767 | 12/1987 | Edelhoff et al. | 414/408 |

*Primary Examiner*—Harvey C. Hornsby

*Assistant Examiner*—K. L. O'Leary

*Attorney, Agent, or Firm*—Shlesinger Arkwright & Garvey

[57] ABSTRACT

A mechanical lock-in device for a front loader compaction assembly to prevent relative movement of the refuse container with respect to the stationary compactor head and support. The lock-in device includes a lock-in bracket fixed to the compactor head support, and a locking member movably mounted on the refuse container adjacent one of the horizontally extending side pockets which are engaged by lifting forks of a collection vehicle for dumping. The lower portion of the locking member engages the lock-in bracket to prevent relative movement of the refuse container while in use. When it is desired to dump the container, when the lifting fork of the collection vehicle is inserted into a container side pocket, it engages a portion of the locking member which extends transversely of the pocket, thereby effecting an upward movement of the locking member out of engagement with the lock-in bracket to permit the container to be moved from its position beneath the stationary head.

11 Claims, 3 Drawing Sheets

FIG 1
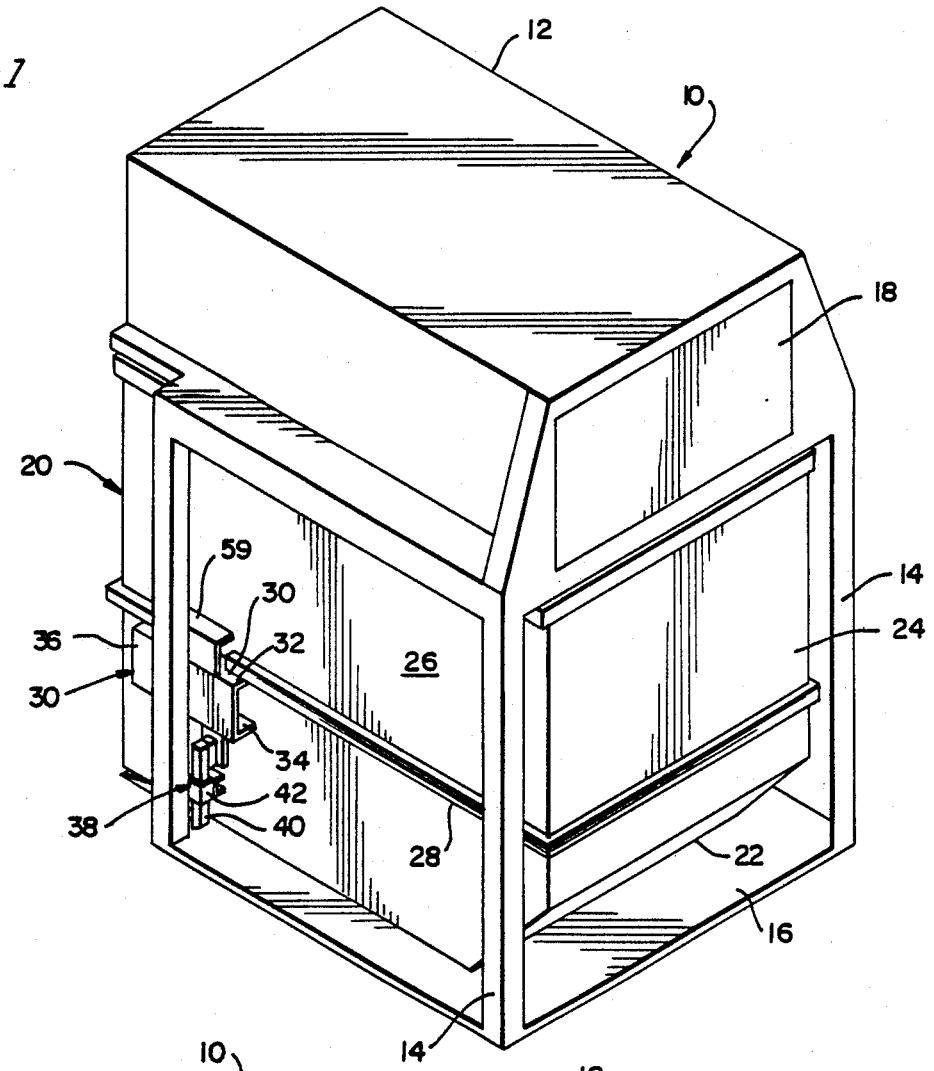
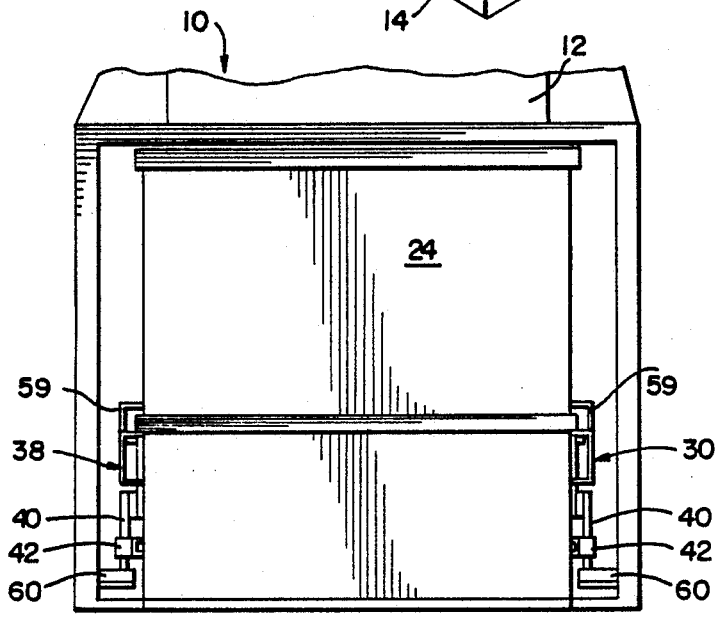
FIG 2

MECHANICAL LOCK-IN DEVICE FOR A FRONT LOADER COMPACTION ASSEMBLY

This invention is a mechanical lock-in device for a front loader compaction assembly.

BACKGROUND OF THE INVENTION

Front loader refuse compactors generally comprise a stationary compactor head which delivers the compacted refuse to a removal container that is serviced by a front loader collection vehicle. It is a desirable feature to permit the operator of the collection vehicle to remove and dump the container without leaving the truck. This is conventionally accomplished by front loader forks which are carried by the truck and which engage complemental pockets arranged along the sides of the container, to permit lifting up of the container for dumping. Up to this time, many compactors rely on gravity and friction to prevent the compaction forces from moving the container away from the head. Other compactors a locking arrangement for preventing movement of the container, but these require a certain sequence of operation which requires skill on the part of the truck driver to unlock and lock the container into position. One illustration of such an arrangement is found in U.S. Pat. No. 3,662,910, issued May 16, 1972, to William A. Herpich et al.

It is an object of the present invention to provide a lock-in device for preventing accidental movement of the refuse container with respect to the compactor head while in operation, which lock-in device automatically releases the container for removal upon insertion of the lifting forks into the container side pockets for dumping the container.

Another object is to provide a lock-in device for a front loader compactor assembly which requires no special maneuvers by the front loader truck operator, thereby effecting disengagement of the container from the compactor head by means of the normal procedure which has been followed for dumping such containers.

A further object is to provide a lock-in device for a front loader compaction assembly wherein the lock-in device is automatically and positively activated when the container is returned to its position for use with the compactor head.

SUMMARY OF THE INVENTION

The lock-in device of the present invention includes a lock-in bracket which is fixed to a stationary part of the compactor head, which bracket engages a locking member which is movably mounted on the refuse container of a front loader compaction assembly having side pockets which are engaged by lifting forks on the collection vehicle.

A portion of the lifting member extends through the side pocket of the container, and is provided with an angular actuating plate which extends transversely of the side pocket in the path of movement of the lifting fork of the collection vehicle when it is inserted into the side pocket for removal and dumping of the refuse container. Upon engagement of the lifting fork with the actuating plate, the plate is lifted upwardly, effecting a corresponding upward movement of the entire locking member out of engagement with the locking bracket, to permit removal of the refuse container for dumping.

Upon replacing the refuse container in position after dumping, when the lifting fork is removed from the side pocket, the locking member gravitates downwardly into locking engagement with the locking bracket.

DESCRIPTION OF THE FIGURES OF THE DRAWING

FIG. 1 is a perspective view of a front loader compactor assembly illustrating the application of the present invention thereto;

FIG. 2 is a fragmentary front elevational view thereof;

DETAILED DESCRIPTION OF THE INVENTION

Figure 4:
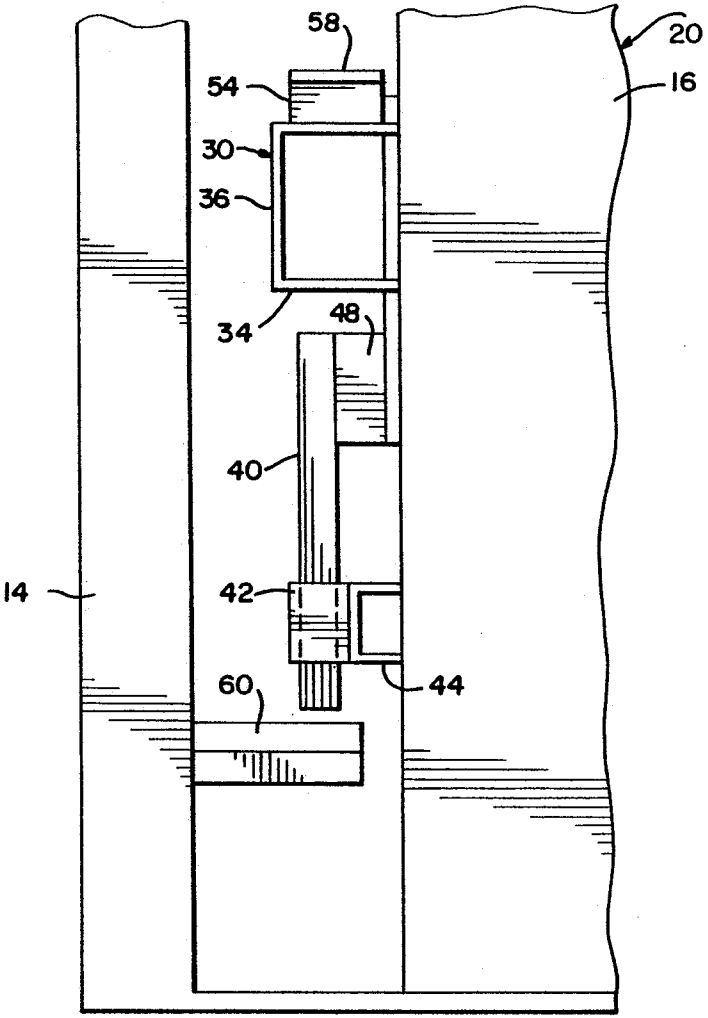
FIG. 4 is an enlarged fragmentary front elevational view thereof showing the lock-in device in operative position.

Referring now in greater detail to the drawings, there is illustrated in FIG. 1 a front loader compaction assembly 10 which includes a compactor head 12 supported by a plurality of legs 14 above a floor 16, the compactor head 12 being provided with a refuse door 18.

A refuse container 20 is supported by floor 16 beneath compactor head 12, which container includes a bottom wall 22, end walls 24 and side walls 26. A container reinforcing rib is indicated at 28, and pockets 30 are affixed to the sides thereof.

Pockets 30 are each of channel-shape, and include a top wall 32 and a bottom wall 34 connected by a side wall 36. As shown to advantage in FIGS. 3 to 6, the lock-in device of the present invention is generally designated 38, which device may be applied to one or both sides 26 of container 20. Lock-in device 38 includes an elongated, vertical lock-in pin 40, an intermediate part of which extends through a guide pipe 42 which is fixed to side wall 26 by a channel-shaped spacer 44 which is fixed to side wall 26 by welding or other suitable means. The lower end of pin 40 is beveled at 46.

The upper end of lock-in pipe 40 is affixed to one face of a spacer plate 48, the opposite face of the spacer plate being secured to the lower end of a flat, elongated connector 50. Connector 50 extends vertically upwardly through an opening 52 in bottom wall 34 of pocket 30, in flush engagement with container side wall 26.

An actuating plate is secured to the upper portion of connection 50, which actuating plate includes a substantially V-shaped member 54 which lies within pocket 30, the upper portion thereof extending through an opening 56 in top wall 32 of pocket 30. The terminals of V-shaped member 54 are bent outwardly to provide flanges 58 which are adapted to engage the upper surface of top wall 32 to support lock-in device 38 in operative position. A protective cover is indicated at 59.

In connection with lock-in device 38, there is provided a lock-in bracket 60 which is secured to leg 14 of the compaction assembly, which bracket is of generally bar shape, and engages the lower end of lock-in pin 40 to prevent accidental movement of refuse container 20 with respect to compactor head 12. It will be noted from a consideration of FIGS. 3 and 5 that a lock-in bracket is angularly disposed to the horizontal, with the higher end thereof proximate locking pin 40.

OPERATION

In use, the lock-in device of the present invention may be applied to one side only, or to both sides of the refuse container, as shown in FIG. 2. In accordance with conventional procedure, when the collection vehicle is positioned proximate the compactor assembly, lifting forks 62 carried by the vehicle are inserted through side pockets 30, preparatory to moving the container away from the compactor head, and then raisins it for dumping into the collection vehicle.

In accordance with the objects of the present invention, as the lifting fork 62 is inserted into the pocket, the end thereof engages the inclined surface of V-shaped member 54 of the actuating plate, resulting in an upward movement of the plate, and a corresponding upward movement of connector 50 and lock-in pin 40 which are Connected thereto. This causes the lower end of lock-in pin 40 to move out of engagement with lock-in bracket 60, thereby freeing the container for removal from its position beneath compactor head 12, to allow the container to be dumped in the collection vehicle.

Figure 3:
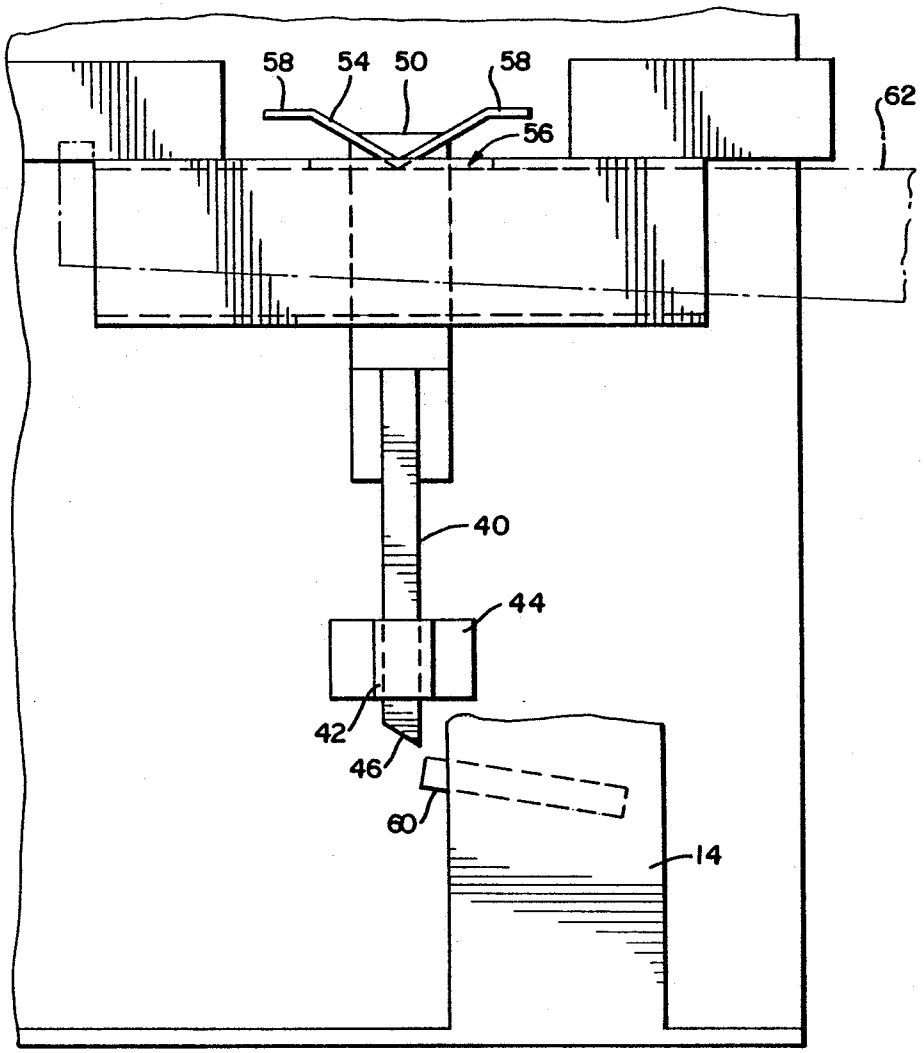
FIG. 3 is an enlarged fragmentary side elevational view thereof.
Figure 6:
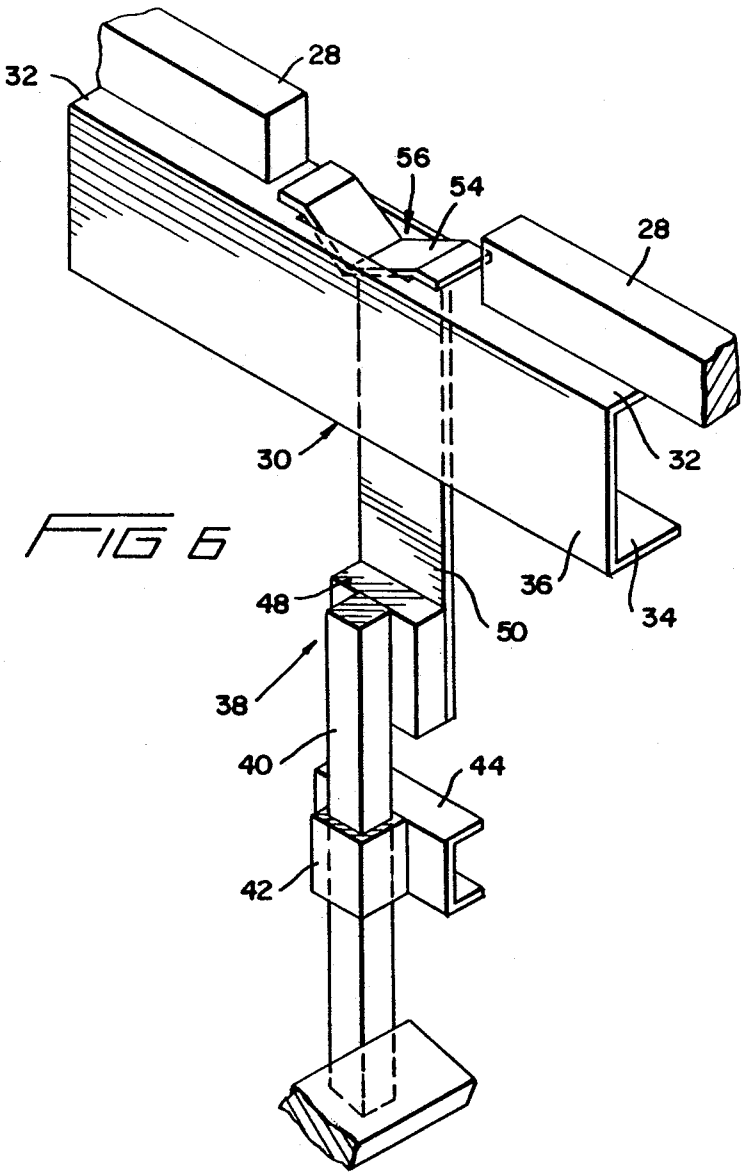
FIG. 6 is a perspective view of the lock-in device of the present invention shown in operative position.
Figure 5:
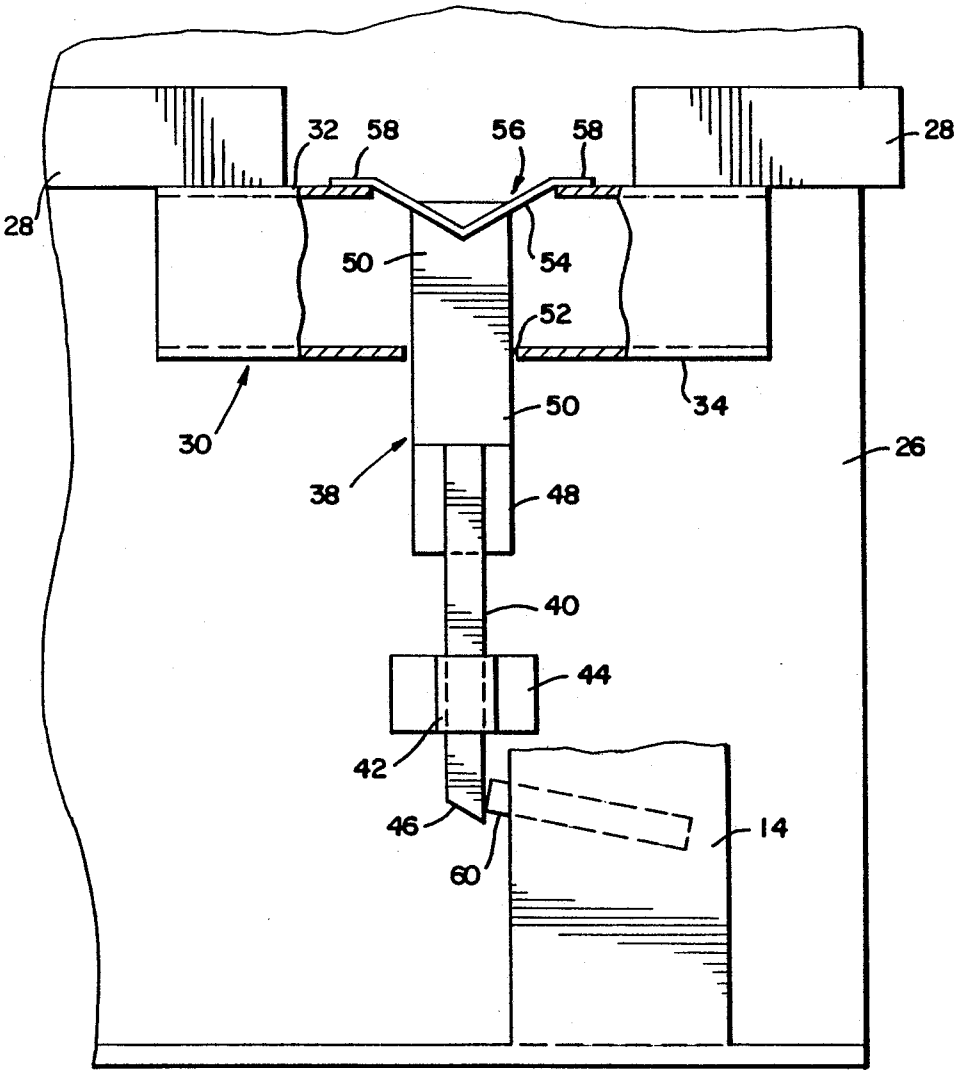
FIG. 5 is an enlarged fragmentary side elevation view showing the lock-in device in operative position.

During this time, by virtue of the engagement of lifting fork 62 with V shaped actuating plate 56, the lock-in device remains in the raised position shown in FIGS. 3 and 4. The container is then returned by the lifting fork to its position beneath compactor head 12.

As the refuse container is moved into position, beveled end 46 of lock-in pin 40 engages the inclined angular surface of lock-in bracket 60 and, as it passes the upper limit thereof, it drops downwardly into locking engagement with the bracket as lifting fork 62 is removed from pocket 30, thereby effecting gravitational movement of the lock-in device downwardly until flanges 58 engage top wall 32 of pocket 30.

The lock-in device of the present invention provides an effective locking means to prevent "walking"of the refuse container with respect to the compactor head of the front loader compaction assembly while it is in operation. The operation of the lock-in device is automatically controlled when the vehicle collection truck inserts the lifting forks into the side pockets of the refuse container to dump the same, and is automatically reset in locking engagement when the refuse container is repositioned in place.

The operation of the present device requires no additional steps or sequence of steps to operate in addition to those which are followed for conventional dumping of the refuse container.

While there has been herein shown and described the presently preferred form of this invention, it is to be understood that such has been done for purposes of illustration only, and that various changes may be made therein within the scope of the appended claims.

What I claim is:

1. In a trash compactor assembly including a stationary compacting head and support, and a movable container subjacent the compacting head for receiving compacted trash, the container side having horizontally extending pockets for receiving lifting forks carried by a truck to effect removal of the container to dump the contents thereof into the truck, a lock-in device for normally retaining said container in fixed relation to the stationary compacting head, said device comprising (a) a first member fixedly connected to a portion of the compacting head and support;

(b) a second member movably supported by said container and engaged with said first member to prevent movement of the container relative to the compacting head while in use;

(c) a portion of said second member being in engagement with a side pocket of the container, and (d) a third member engaged with said second member and lying within the side pocket of said container in the path of the truck fork when it is inserted into the pocket;

(e) said third member being moved by the fork as it passes through the side pocket, thereby effecting a corresponding movement of said second member, in a direction to remove it from engagement with said first member, to permit removal of the container from its position subjacent the stationary head for dumping, said second and third members returning to their initial position upon removal of the fork from the side pocket, thereby effecting locking engagement of said second member with said first member when the container is replaced in position subjacent the stationary head.

2. The lock-in device of claim 1, wherein (a) the support for the compacting head comprises legs for positioning the compacting head a predetermined distance from the ground, and (b) said first member comprises a lock-in bracket affixed to one of said legs.

3. The lock-in device of claim 2, wherein (a) said lock-in bracket comprises an elongated bar member which is angularly disposed in the supporting surface.

4. The lock-in device of claim 1, wherein (a) said second member includes an elongated vertically movable locking member;

(b) the lower end of said locking member normally engaging said first member to prevent movement of the container relative to the compacting head.

5. The lock-in device of claim 1, wherein (a) said third member is angularly disposed with respect to the longitudinal axis of the container side pocket.

6. The lock-in device of claim 5, wherein (a) said actuating member is of substantially V-shape;

(b) the upper portion of said actuating member being supported by the pocket of the container.

7. The lock-in device of claim 6, wherein (a) the top of the side pocket is provided with a top wall having an opening through which a portion of said V-shaped actuating plate passes;

(b) the upper extremities of said V-shaped actuating plate bent outwardly to provide flanges engaged with the top wall of the side pocket to support said second means.

8. In a trash compactor assembly including a stationary compacting head and supporting legs, and movable container subjacent the compacting head for receiving compacted trash, the container sides having horizontally extending pockets for receiving lifting forks carried by a truck to effect removal of the container to dump the contents thereof into the truck, a lock-in device for normally retaining said container in fixed relation to the stationary compacting head, said device comprising (a) a lock-in bracket affixed to one of the supporting legs of the trash compactor assembly, and (b) an elongated vertically movable locking member having upper and lower ends engaged with the container, the lower end of said locking member being engaged with said lock-in bracket to prevent movement of the container relative to the compacting head while in use;

(c) the upper end of said locking member extending transversely through the container pocket;

(d) a portion of the locking member within the pocket being angular disposed to the longitudinal axis of the pocket and lying in the path of movement of the truck fork inserted into the container pocket;

(e) said angularly disposed portion being engaged by the truck fork and lifted upwardly as the truck fork is inserted into the container pocket and passed therethrough, thereby effecting a corresponding upward movement of said locking member out of engagement with said lock-in bracket, to permit removal of the container from the stationary head for dumping, said locking member returning to its initial position upon removal of the fork from the container pocket, thereby effecting locking engagement of said locking member with the lock-in bracket when the container is replaced in position subjacent the stationary head.

9. The lock-in device of claim 8, wherein (a) said angularly disposed portion of said locking member is a substantially V-shaped actuating plate, and (b) means for supporting said locking member in locking engagement with said lock-in bracket.

10. The lock-in device of claim 9, wherein (a) said means includes an opening in the top of the pocket through which a portion of said V-shaped actuating plate passes;

(b) the upper extremity of said V-shaped actuating plate bent outwardly to provide flanges which engage that part of the top of the pocket adjacent the opening, to support said locking member in operative engagement with said lock-in bracket.

11. The lock-in device of claim 10, wherein (a) said lock-in bracket is angularly disposed at an upward inclination to facilitate engagement thereof with said locking member when the container is positioned subjacent the compactor head.

* * * * *